United States Patent [19]

Hammer et al.

[11] 4,352,448

[45] Oct. 5, 1982

[54] APPARATUS FOR DRYING SHEET-LIKE PHOTOGRAPHIC MATERIAL

[75] Inventors: Thomas Hammer; Wilfried Hehn; Franz Kocourek; Werner Sieber, all of Munich; Viktor Osegowitsch, Taufkirchen, all of Fed. Rep. of Germany

[73] Assignee: AGFA-Gevaert Aktiengesellschaft, Leverkusen, Fed. Rep. of Germany

[21] Appl. No.: 212,604

[22] Filed: Dec. 3, 1980

[30] Foreign Application Priority Data

Dec. 21, 1979 [DE] Fed. Rep. of Germany ..... 2951845

[51] Int. Cl.[3] ..... B65H 17/20; B65H 17/22

[52] U.S. Cl. ..... 226/108; 226/189

[58] Field of Search ..... 226/108, 109, 24, 119, 226/189; 34/159, 161

[56] References Cited

U.S. PATENT DOCUMENTS

| | | | |
|---|---|---|---|
| 1,664,735 | 4/1928 | Copstaff | 226/119 X |
| 3,656,676 | 4/1972 | Hope | 226/189 |
| 4,011,975 | 3/1977 | Brown | 226/109 |
| 4,077,137 | 3/1978 | Edgington | 34/70 |
| 4,214,379 | 7/1980 | Hope | 226/189 |

FOREIGN PATENT DOCUMENTS

| | | | |
|---|---|---|---|
| 2153752 | 10/1971 | Fed. Rep. of Germany | 226/108 |
| 2615905 | 10/1976 | Fed. Rep. of Germany | 226/108 |

*Primary Examiner*—Edward J. McCarthy

*Attorney, Agent, or Firm*—Kontler, Grimes & Battersby

[57] ABSTRACT

Apparatus for drying sheets of photographic material has a group of parallel lower horizontal shafts and a group of parallel upper horizontal shafts which are staggered with reference to the lower shafts. All of the shafts extend transversely of the direction of travel of sheets therebetween and carry elastic rollers which engage and advance the sheets. Certain shafts carry holders for U-shaped guide members which flank the path of the sheets between the rollers on the upper and lower shafts and prevent the leaders of the sheets from curling into the spaces between the upper or lower shafts. The distance between the axes of two neighboring lower or upper shafts is at least 2D and the distance between the upper and lower guide members is less than D, wherein D is the outer diameter of a roller. The spaces between the rows of rollers on neighboring upper and lower shafts serve (a) to provide room for nozzles which discharge streams of hot gaseous fluid to expel moisture from advancing sheets and (b) to provide room for evacuation of moisture-laden fluid.

20 Claims, 4 Drawing Figures

APPARATUS FOR DRYING SHEET-LIKE PHOTOGRAPHIC MATERIAL

BACKGROUND OF THE INVENTION

The present invention relates to apparatus for drying sheets or strips of flexible material, and more particularly to improvements in apparatus for reducing the moisture content of sheets or strips of photosensitive material such as photographic films, photographic paper or the like. Still more particularly, the invention relates to improvements in apparatus for drying sheets or strips of photosensitive material (hereinafter called sheets for short) while the sheets are contacted, at both sides, by driven rollers and while the sheets are subjected to the action of a fluid medium which is caused to impinge against both sides thereof.

Apparatus for drying sheets of photosensitive material while the sheets are transported by driven rollers and are acted upon by streams of a hot gaseous fluid are disclosed, for example, in German Auslegeschrift No. 2,615,905 and in German Pat. No. 2,153,752. The rollers which advance the sheets along a path extending between two sets or groups or rollers are mounted on shafts which are driven by a motor or the like. The neighboring shafts at each side of the path for the sheets are so closely adjacent to each other that, if the leader of a sheet which is caused to advance through the drying or moisture expelling zone is engaged by a row of rollers on a first shaft and is directed against the rollers on the next-following shaft, the plane of the leader makes an acute angle with the plane which is tangential to the rollers and disposed between the two sets or groups of rollers. This ensures that the rollers on the next-following shaft can direct the leader back into the ideal path and on toward the peripheries of the rollers on the next-following shaft, and so forth. A drawback of such drying apparatus is that the shafts at each side of the path for the sheets to be dried are very closely adjacent to each other in order to guarantee that the actual path along which the sheets move is a meandering path sloping alternately toward a row of rollers at one side of the path, thereupon toward a row of rollers at the other side of the path, again toward a row of rollers at the one side of the path, and so forth. The degree to which the path meanders depends on the extent to which the rollers at one side of the path extend beyond the ideal path for the sheets, i.e., beyond a plane which is tangential to the rollers of the group or set of rollers at the other side of the path. While the mounting of a group of neighboring shafts at each side of the path exhibits the advantage that the configuration of a meandering path (if such path is desired or necessary) can be regulated within a narrow range, the drawbacks of such drying apparatus outweigh the advantages because the closely adjacent shaft and the rows of rollers thereon provide little room for admission of a gaseous moisture expelling fluid and for evacuation of moisture-laden fluid from the region of advancement of successive sheets through the apparatus. As a rule, the gaseous fluid is hot air which is blown against both sides of a moving sheet. Proper drying of a sheet in such apparatus can be accomplished only by unduly extending the path along which the sheets move through the drying zone. This contributes to space requirements of the drying apparatus as well as to the initial and maintenance costs. Apparatus of the type to which the present invention pertains may constitute integrated or separable units of production lines in photographic processing laboratories wherein exposed but undeveloped customer films are removed from cassettes or analogous containers, spliced together to form relatively large rolls of coherent films, transported through a developing machine, dried by exposure to hot air or another suitable gaseous fluid, and conveyed through a printing or copying machine if the customers desire to obtain prints of all or selected film frames.

A further drawback of presently known drying apparatus of the above outlined character is that, if the leaders of discrete sheets or strips exhibit a strong tendency to curl, they are likely to penetrate into the spaces between neighboring shafts at the one or the other side of the path with the result that the sheets or strips are deformed, defaced or totally destroyed. Such penetration of curling leaders of sheets or strips will take place even if the neighboring shafts at both sides of the path are very closely adjacent to each other, i.e., if the neighboring shafts are so close to each other that there is little room for installation of adequate nozzles which admit hot gaseous fluid and/or for removal of moisture-laden gases from the region of the path.

OBJECTS AND SUMMARY OF THE INVENTION

An object of the invention is to provide an apparatus for expelling moisture from travelling sheets or strips of photosensitive material while the sheets or strips advance along a relatively short path.

Another object of the invention is to provide a drying apparatus which is more compact and simpler than heretofore known apparatus and which can effect rapid and uniform drying of successive sheets or webs without streaking and/or similar undesirable effects which often accompany or are the result of the drying of sheets or strips in conventional apparatus.

A further object of the invention is to provide the apparatus with novel and improved means for selecting and adjusting the path along which the strips or sheets advance through the drying zone.

An additional object of the invention is to provide the apparatus with novel and improved guide means for ensuring that the sheets or strips remain in the selected path and that each side of a sheet or strip which advances along the selected path can be brought into contact with large quantities of relatively dry moisture-withdrawing gaseous fluid.

A further object of the invention is to provide novel and improved means for mounting the means which guide successive strips or sheets along a selected path on the shafts for the transporting or advancing elements of the apparatus.

An ancillary object of the invention is to provide novel and improved means for prolonging the useful life of deformable transporting elements for sheets or webs of photosensitive material in an apparatus of the above outlined character.

Another object of the invention is to provide a drying apparatus which is just as simple as but more effective and less prone to malfunction than heretofore known apparatus, which can be readily installed in existing photographic processing laboratories as a superior substitute for conventional drying apparatus, and wherein all parts which require frequent or irregular inspection or maintenance are readily accessible with little loss in time.

Another object of the invention is to provide a drying apparatus which is constructed and assembled in such a way that the leaders of sheets or strips cannot be caught between neighboring shafts or rows of rollers at the one or the other side of the path even if the leaders exhibit a strong tendency to curl.

A further object of the invention is to provide a novel and improved array or shafts and sheet- or strip-advancing rollers in an apparatus of the above outlined character.

One feature of the invention resides in the provision of an apparatus for drying running strips or sheets of photographic material, e.g., photographic paper issuing from a developing machine. The apparatus comprises first and second groups of transporting rollers having a predetermined diameter and defining an elongated path for advancement of strips or sheets therebetween in a predetermined direction, and first and second groups of parallel shafts which support the rollers of the respective groups and extend transversely of the direction of transport of the photographic material. The shafts of each group of shafts are spaced apart from each other by distances each of which at least equals (but can appreciably exceed) 2D wherein D is the predetermined diameter of a roller. The apparatus further comprises elongated guide members which are disposed at the opposite sides of the path for photographic material and extend in the aforementioned direction to guide the photographic material in the path. The guide members at one side of the path are separated from the guide members at the other side of the path by a distance which is less than D.

In accordance with a presently preferred embodiment of the invention, the guide members consist of wire or similar rod stock having a diameter of between 0.5 and 2 mm, preferably about 1 mm. Each guide member may constitute a substantially U-shaped body having two elongated parallel prongs which extend in the direction of transport of the photographic material and a relatively short web between the rear end portions of the respective prongs. The web is releasably secured to the nearest shaft by a novel holder which is preferably elastic or partly elastic and is separably connected to the respective shaft, e.g., owing to its innate elasticity. To this end, the holder can have an annular portion which surrounds a major part of the respective shaft between two neighboring rollers and one or more hook-shaped elastic coupling portions which engage the web of the corresponding guide member.

The rollers of one group are driven by a motor or another suitable prime mover which is installed in the housing of the drying apparatus and transmits torque to the respective group of shafts by way of a chain transmission. The rollers are annuli of porous elastomeric plastic material, and such annuli are expanded so as to frictionally engage the respective shafts.

The novel features which are considered as characteristic of the invention are set forth in particular in the appended claims. The improved drying apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
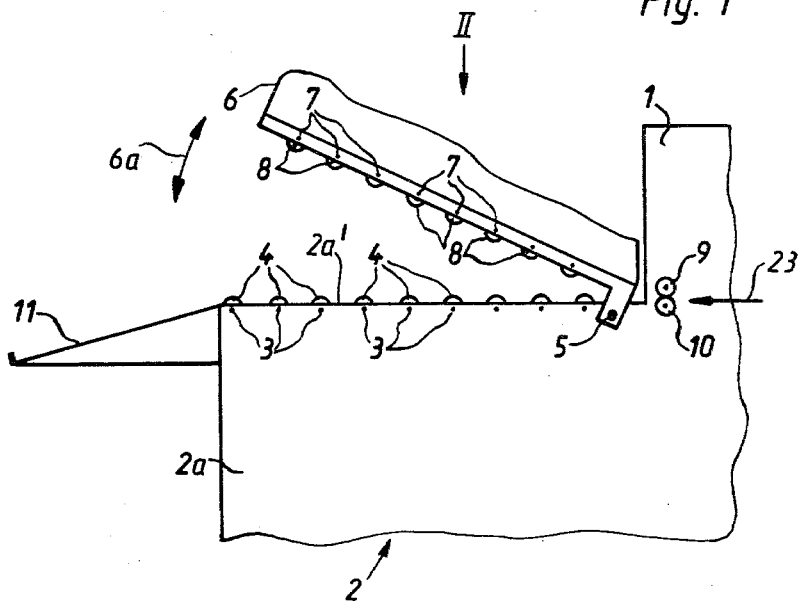
FIG. 1 is a fragmentary side elevational view of a developing machine and of a drying apparatus which embodies the present invention, the upper portion of the housing of the drying apparatus being shown in open or raised position to afford access to the rollers and guide members.
Figure 3:
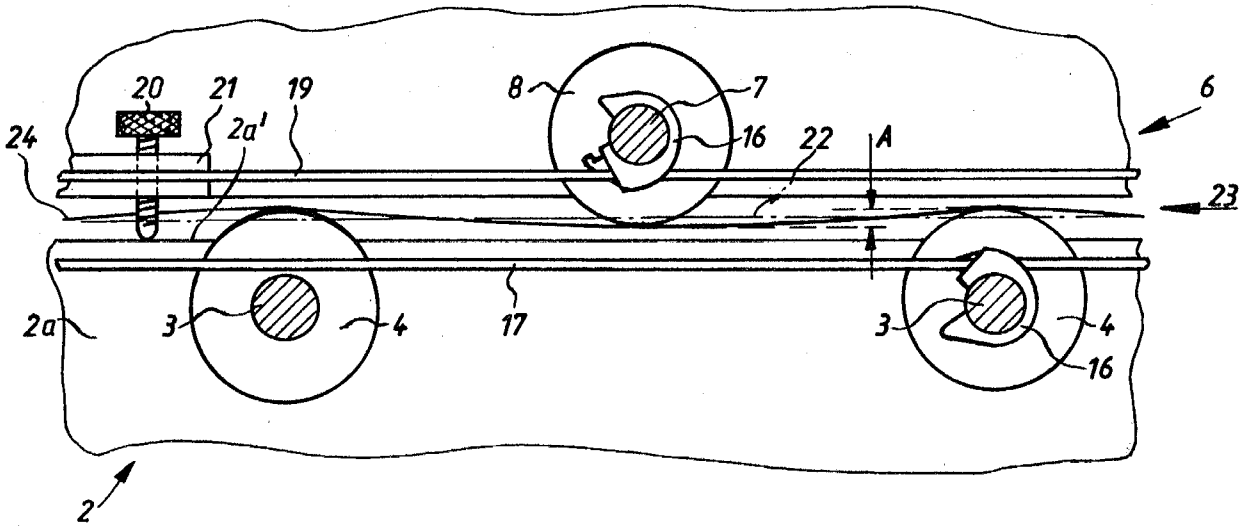
FIG. 3 is a fragmentary sectional view as seen in the direction of arrows from the line III—III of FIG. 2.

FIG. 1 shows a portion of a developing machine 1 which discharges a continuous strip or a succession of discrete sheets 24 (see FIG. 3) of photosensitive material. The illustrated portion of the developing machine 1 constitutes that part or end which is adjacent to a drying or moisture reducing apparatus 2 embodying one form of the present invention. The apparatus 2 is designed in such a way that it defines a substantially horizontal path (the ideal path is indicated in FIG. 3 by the phantom line 22) for successive sheets 24 of photosensitive material. Such path is defined (a) by a first or lower group of advancing or transporting rollers 4 which are mounted on a first group of parallel horizontal shafts 3 extending at right angles to the direction (arrow 23 in FIG. 3) of forward transport of successive sheets 24 and (b) by a second or upper group or set of advancing or transporting rollers 8 mounted on a second group of horizontal shafts 7 which are parallel to the shafts 3. The axes of all shafts 3 are disposed in a first horizontal plane and these shafts are journalled in the stationary lower portion or base **2*a* of the housing of the drying apparatus 2. The axes of shafts 7 are also disposed in a common plane, and such shafts are journalled in a mobile portion or cover 6 of the housing of the drying apparatus 2. The cover 6 is pivotally secured to the lower portion 2*a*, as at 5, so that it can be pivoted in the directions indicated by a double-headed arrow 6*a* in order to enable an attendant to gain access to the path for the sheets 24** with little loss in time.

Figure 2:
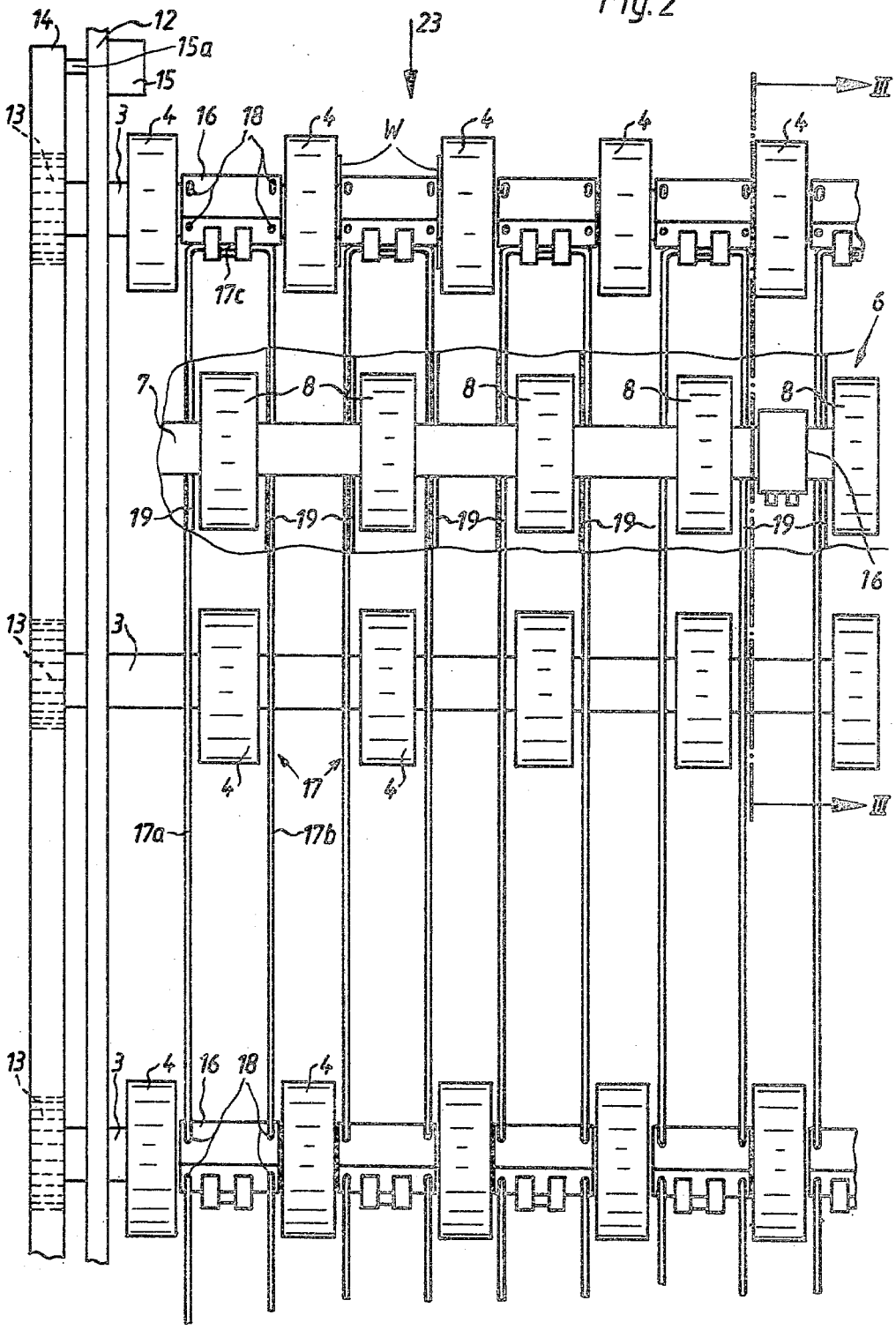
FIG. 2 is a greatly enlarged fragmentary plan view of the lower portion of the housing of the drying apparatus, substantially as seen in the direction of arrow II in FIG. 1, and further showing a fragment of the upper portion of the housing which is held in the closed position.

Each of the shafts 3 carries a row of preferably equidistant rollers 4, and each of the shafts 7 carries a row of preferably equidistant rollers 8. As shown in FIG. 2, the rollers 8 on the upper shafts 7 are preferably staggered with reference to the rollers 4 on some of the lower shafts 3, as considered transversely of the direction of forward movement of sheets 24 (in FIG. 2, the sheets 24 advance downwardly as indicated by the arrow 23). FIGS. 2 and 3 further show that the shafts 3 and 7 are staggered with reference to each other, as considered in the direction of the arrow 23.

The angular position of the cover 6 ( in the operative position of the drying apparatus 2) can be selected in such a way that the line 22 denoting in FIG. 3 the ideal path for succesive sheets 24 is tangential to all of the rollers 4 and 8. However, the drying apparatus 2 can be (and preferably is) provided with means for maintaining the cover 6 in any one of a plurality of different angular positions to thereby ensure that the rollers 8 overlap the rollers 4 to a selected extent so that the path for successive sheets 24 is actually a slightly or markedly undulate or meandering path. This can be seen in FIG. 3 wherein the lowermost portions of the upper rollers 8 (only one shown) extend downwardly beyond the ideal path 22 to the extent which is indicated at A so that the sheet 24 which is simultaneously engaged by the rollers 8 and 4 assumes a slightly undulate shape. The extent of undulation is selected with a view to ensure satisfactory progress of successive sheets 24 through the drying apparatus 2, i.e., to ensure satisfactory frictional engagement between the peripheral surfaces of the rollers 4 and 8 on the one hand and the corresponding sides of the travelling sheets 24 on the other hand. The means for selecting the angular position of the cover 6 comprises one or more screws 20 (FIG. 3) meshing with a strip-shaped member 21 secured to the leftmost part of the cover 6, as viewed in FIG. 1. The tip or tips of the screw or screws 20 rest on the upper surface 2*a'* of the lower portion 2*a* of the housing of the drying apparatus 2. Other adjusting or selecting means (such as a rack and pinion drive or an eccentric) can be utilized with equal advantage to accomplish the same result, i.e, to select the extent (A) of overlap between the upper rollers 8 and the lower rollers 4.

FIG. 1 further shows a pair of advancing rolls 9 and 10 at least one of which is driven in a manner not specifically shown in the drawing so as to advance successive developed sheets 24 from the developing machine 1 into the path between the two groups of rollers 4 and 8. Dried sheets 24 are stacked on or in a downwardly sloping platform or tray 11 at the discharge end of the ideal path 22, i.e., at the left-hand side of the lower housing portion 2*a*, as viewed in FIG. 1.

It goes without saying that the housing of the drying apparatus 2 is provided with means for circulating a moisture-expelling or moisture-removing gaseous fluid (e.g., hot air) along both sides of a sheet 24 which advances between the lower portion 2*a* and the cover 6 toward the platform or tray 11. The streams of hot air preferably issue through slit-shaped orifices of nozzles (not shown) which extend transversely of the direction indicated by the arrow 23 and discharge hot air against both sides of the advancing sheets 24. The housing of the drying apparatus 2 further comprises means for collecting or withdrawing moisture-laden air from the housing. Reference may be had to the commonly owned copending application Ser. No. 212,605 filed Dec. 3, 1980 by Hammer et al. for "Apparatus for Drying Webs or Sheets of Photosensitive Material" which discloses suitable means for discharging narrow streams of a hot gaseous fluid against both sides of moving sheets to complete the drying operation while the sheets advance along a relatively short path.

FIG. 2 illustrates a part of the lower housing portion 2*a* and three shafts 3 with rollers 4 thereon. FIG. 2 further shows a portion of the cover 6 with a shaft 7 and a row of rollers 8 thereon. It will be seen that the shaft 7 is disposed substantially midway between the neighboring shafts 3, and that the rollers 8 on the shaft 7 are aligned with the rollers 4 of the next-following shaft 3 (as considered in the direction of the arrow 23) but are staggered with reference to the rollers 4 on the preceding shaft 3. Thus, neighboring rows of rollers 4 can be staggered with reference to each other, and the same preferably applies for the neighboring rows of rollers 8.

The rollers 4 on the lower shafts 3 are positively driven by a prime mover 15 (e.g., a small electric motor) which is mounted at the inner side of an upright supporting wall 12 forming part of the housing portion 2*a*. The wall 12 further carries suitable bearings (not specifically shown) for the respective end portions of the shafts 3. These shafts extend outwardly through the wall 12 and are provided with sprocket wheels 13 mating with an endless chain 14 which is driven by a further sprocket wheel (not specifically shown) on the output shaft 15*a* of the prime mover 15. The upper rollers 8 are rotated by the sheets 24 in response to rotation of the lower rollers 4.

Each of the rollers 4 may constitute a simple annulus made of a foamed synthetic plastic material having (in the undeformed condition thereof) an inner diameter which is less than the diameter of the respective shaft 3. Thus, the rollers 4 can be slipped onto the respective shafts 3 and remain in selected positions (as considered in the axial direction of the respective shaft) owing to frictional engagement with the periphery of the shaft. The construction of the rollers 8 and the mounting thereof on the respective shafts 7 is preferably the same. The outer diameters (D) of all properly mounted rollers 4 are preferably identical with those of the properly mounted rollers 8.

Figure 4:
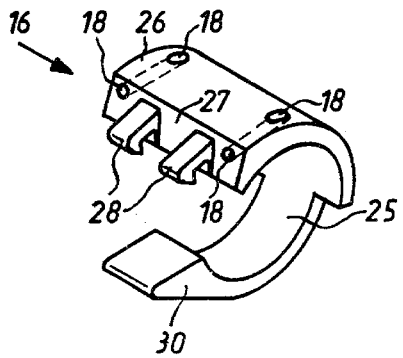
FIG. 4 is an enlarged perspective view of a holder which is used in the drying apparatus to couple guide members to selected shafts for the sheet advancing or transporting rollers.

Alternate shafts 3 carry holders 16 which are disposed between neighboring rollers 4 and serve to detachably support elongated U-shaped guide members 17 for the sheets 24. A presently preferred construction of holders 16 is illustrated in FIG. 4. The purpose of the holders 16 is to allow for rapid attachment of guide members 17 and to ensure that each attached guide member 17 is maintained in an optimum position to properly steer a travelling sheet 24 along the path which extends from the advancing rolls 9, 10 of the developing machine 1 toward the tray 11.

The guide members 17 are elongated, as considered in the direction of the arrow 23, i.e., in the direction of transport of successive sheets 24. Each guide member 17 resembles a U-shaped needle with two prongs 17*a*, 17*b* which are parallel to the direction indicated by the arrow 23, and a transversely extending web 17*c* which is disposed between two neighboring rollers 4 and is detachably secured to the corresponding holder 16. The length of the webs 17*c*, as considered at right angles to the direction of transport of the sheets 24, is somewhat less than the distance between two neighboring rollers 4 on a shaft 3. The uppermost shaft 3 of FIG. 2 is assumed to be adjacent to the pivot 5 for the cover 6, i.e., close to the inlet of the path wherein the sheets 24 are relieved of moisture during transport through the drying apparatus 2. The median shaft 2 of FIG. 2 does not carry any holders 16, and the lowermost shaft 3 of FIG. 3 carries holders 16 which, however, merely serve to prop and guide the adjacent portions of the prongs 17*a*, 17*b*. To this end, the holders 16 have pairs of parallel holes or passages 18 which allow the prongs 17*a* and 17*b* to pass therethrough. In addition to the just outlined functions, the holders 16 can serve as distancing elements between neighboring rollers 4 on the corresponding shafts 3. If desired, washers (two shown in FIG. 2 at W) can be installed between the holders 16 and the adjacent rollers 4 in order to reduce the likelihood of deformation of the rotating rollers by the stationary holders 16 when the prime mover 15 drives the shafts 3 and the shafts 3 rotate the respective rollers 4. As explained above, the rollers 4 may constitute relatively soft annuli made of an elastomeric foamed plastic material which is not likely to damage the respective surfaces of the sheets 24; in view of such selection of the material of the rollers 4, they cannot stand pronounced deforming or other stresses which, in turn, explains the advisability of the privision of washers W.

The guide members 17 are preferably made of a wire or similar stock having a diameter of between 0.5 and 2 mm, most preferably approximately 1 mm. Relatively thin wire is preferred because the guide members 17 are then highly unlikely to intercept appreciable quantities of hot air which is blown against the respective side of a travelling sheet 24, i.e., the sheet is subjected to a uniform drying action which reduces the likelihood of streaking and/or other undesirable effects of drying.

Each guide member 17 can extend along the entire path for the sheets 24 in the drying apparatus 2. However, it is equally within the purview of the invention to employ several sets of shorter guide members and to provide holders 16 on each and every shaft 3, depending on the length and rigidity of the prongs 17*a* and 17*b*.

FIGS. 2 and 3 show that the drying apparatus 2 further comprises upper guide members 19 which are preferably identical with the lower guide members 17 and are mounted on one or more upper shafts 7. For example, the web (not specifically shown) of each upper guide member 19 can be secured to a holder 16 on the rightmost shaft 7 (i.e., on that shaft 7 which is nearest to the pivot pin 5 of FIG. 1) and the guide member 19 can be guided by holders on some or all of the remaining shafts 7, depending on the length of the prongs of the guide member 19 and on the stiffness of such prongs. The mounting of the upper guide members 19 is such (see FIG. 2) that their prongs are disposed between the prongs 17*a*, 17*b* of pairs of lower guide members 17. As a rule, the guide members 17 and 19 are not subjected to pronounced deforming or other stresses. All they must do is to guide flexible sheets or webs of photosensitive material and to withstand the deforming action, if any, of air streams which are directed against the respective sides of the sheets or strips in the space between the lower housing portion 2*a* and the cover 6. Therefore, it is normally sufficient to provide holders for the prongs of the guide members 17 and 19 only on certain shafts 3 and 7. However, and as already pointed out above, it is equally within the purview of the invention to employ holders on each and every shaft 3 and 7, i.e., to attach the webs of the guide members 17 and 19 to the holders 16 on the rightmost shafts 3 and 7 and to guide the prongs of such guide members through the holes 18 of holders 16 on each and every other shaft 3, 17. This contributes to stability of the guide means for the sheets 24.

FIG. 3 shows that the holders 16 (only one shown) on an upper shaft 7 are identical (but inverted with reference) to the holders 16 on a lower shaft 3. This is desirable and advantageous because it contributes to lower cost of the drying apparatus 2. The holes 18 in the holders 16 on the shaft 7 are disposed below the shaft 7 because the respective guide member 19 is also located below the shaft 7. On the other hand, the holes 18 of the holders 16 on the lower shafts 3 are disposed above the respective shafts 3 because the guide members 17 are adjacent to the undersides of sheets 24 travelling along or close to the ideal path 22, i.e., the prongs 17*a* and 17*b* of the lower guide members 17 are disposed above the shafts 3.

The number of the aforementioned adjusting or orientation selecting screws 20 preferably exceeds one and most preferably exceeds three, especially if the drying apparatus 2 is designed for expulsion of moisture from relatively wide sheets 24 (the width of such sheets can be between 1 and 2 meters). In such apparatus, a single adjusting screw 20 would be incapable of ensuring or unlikely to ensure the retention of each and every portion of the cover 6 at a selected distance above the top surface 2*a*′ of the lower portion 2*a* of the housing of the drying apparatus 2. The tips of the screws 20 can abut against the upper edge face of the aforementioned supporting wall 12 for the prime mover 15 and chain 14. As a rule, the extent to which the rollers 4 and 8 cause the sheets 24 to undulate will be reduced (i.e., the distance A shown in FIG. 3 will be reduced) if the material of the sheets 24 is highly sensitive to mechanical stresses. On the other hand, the extent to which the sheets 24 are undulated will be increased if the attendant desires to ensure that the peripheral surfaces of the rollers 4 and 8 will not slip relative to the respective sides of successive sheets.

Save for the fact that the shafts 7 need not be positively driven (even though this is not excluded) and that such shafts are mounted in the pivotable cover 6, the construction and mounting of such shafts (as well as of all parts mounted on and associated with the shafts 7) are preferably identical with those of the lower shafts 3. This contributes to simplicity and lower cost of the drying apparatus.

It will be noted that, in FIG. 3, the distance between two neighboring shafts 3 is greater than the distance between two neighboring shafts 3 in FIG. 2. In FIG. 3, the distance between the axes of the shafts 3 shown therein is almost exactly four times the diameter D (namely, the outer diameter) of a roller 4 or 8. The distance should exceed two diameters D in order to provide ample room for the aforementioned gas-admitting nozzles and for evacuation of moisture-laden gases from the region between the upper and lower groups of rollers.

The distance between the guide members 17 and the path 22 for the sheets 24 is preferably less than D/2 wherein D is the outer diameter of a properly mounted roller 4 or 8. The same holds true for the distance between the upper guide members 19 and the path for the sheets 24. Thus, the distance between the upper and lower guide members 19 and 17 is less than D. Such positioning of the upper and lower guide members relative to each other ensures that the leaders of successive sheets 24 invariably make a very small acute angle with the plane of the ideal path 22 when the sheets 24 advance through the gap between the upper rollers 8 and the lower rollers 4. This, in turn, ensures that the leaders of the sheets 24 can slide along the peripheries of the rollers 4 and 8 rather than tending to penetrate into the spaces between neighboring shafts 3 or 7 (depending on the preferred tendency of the leaders of the sheets 24 to curl).

The mode of operation of the improved drying apparatus 2 will be understood with reference to FIGS. 1 to 3. The advancing rolls 9 and 10 deliver successive freshly developed sheets 24 (e.g., sheets of photographic paper) into the space between the lower portion 2*a* and the cover 6 of the housing of the drying apparatus 2. The cover 6 is held in closed position and the tips of the screws 20 rest on the wall 12 to ensure that the rollers 8 on the upper shafts 7 are maintained at a preselected level above the lower housing portion 2*a*. The leader of a freshly developed (oncoming) sheet 24 is engaged by the driven rollers 4 on the rightmost shaft 3 of FIG. 1, and such sheet is thereupon caused to advance along the ideal path 22 or a similar path toward and into the tray 11. The rollers 4 on the rightmost shaft 3 of FIG. 1 raise the leader of a sheet 24 slightly above the plane of the ideal path 22 so that the leader contacts the peripheral surfaces of the rightmost row of rollers 8 in an orientation in which the angle between the plane of such leader and the ideal path 22 is a very small acute angle (it being assumed here that the rollers 4 and 8 overlap to the extent A as shown in FIG. 3). The rightmost row of rollers 8 deflects the leader of the sheet 24 downwardly so that the leader impinges upon the peripheral surfaces of the next row of lower rollers 4 (again at a very small acute angle with reference to the plane of the ideal path 22), and so forth. This imparts to the sheet 24 the slightly undulate shape which is shown in FIG. 3.

The purpose of the guide members 17 and 19 is to counteract more pronounced tendencies of the leaders of successive sheets 24 to curl, i.e., tendencies of the leaders of such sheets to penetrate between the neighboring shafts 3 or between the neighboring shafts 7 on their way from the advancing rolls 9 and 10 toward the tray 11. If the leaders of the sheets 24 exhibit a pronounced tendency to curl, such leaders slide along the prongs of the guide members 17 or 19 to be thereby guided into desirable engagement with the next-following rollers 4 or 8, i.e., at the aforementioned small acute angle with reference to the plane of the ideal path 22. Thus, by the simple expedient of providing the rather inexpensive guide members 17 and/or 19, one ensures that the sheets 24 remain in the space between the two groups of rollers 4 and 8, i.e., that pronounced tendency of the leaders of the sheets 24 to curl cannot result in any damage to such sheets and/or in clogging of the drying apparatus 2.

Referring to FIG. 4, there is shown a holder 16 which preferably constitutes a one-piece injection molded synthetic plastic article. The holder 16 comprises a somewhat elastic arcuate or partly annular portion 25 which extends or can extend along an arc of approximately 270 degrees so as to surround a substantial portion of a shaft 3 or 7 between two neighboring rollers 4 or 8. The upper section 26 (as viewed in FIG. 4) of the arcuate portion 25 of the holder 16 has a greater width and greater thickness than the remaining part of the portion 25. The width of the section 26 is somewhat less than the distance between two neighboring rollers 4 or 8 on the respective shaft 3 or 7. If the shafts 3 and 7 carry washers W, the width of the section 26 plus the combined thickness of two washers W equals or approximates the spacing between two neighboring rollers 4 or 8 of a given row of rollers on a shaft 3 or 7. On the other hand, the width of the section 26 (as considered in the axial direction of the respective shaft 3 or 7) exceeds the distance between the prongs 17*a*, 17*b* of a guide member 17 or between the prongs of a guide member 19. The section 26 has two parallel holes 18 which, as already explained hereinabove, serve to receive intermediate portions of the prongs 17*a*, 17*b* or of the prongs forming part of the upper guide members 19. The holes 18 are substantially tangential to the internal surface of the section 26. The spacing between the holes 18 equals or approximates the desired spacing of the prongs 17*a*, 17*b* of a guide member 17 or the desired spacing between the prongs of a guide member 19. The front ends of the holes 18 terminate in a flat surface 27 at the front side of the section 26, as considered in the direction of arrow 23 when the holder 16 of FIG. 4 is mounted on a shaft 3 or 7. The holder 16 of FIG. 4 further comprises two hook-shaped retaining or engaging elements 28 which extend forwardly of the front surface 27 of the section 26 and serve to engage the web 17*c* of a guide member 17 or the web of a guide member 19. The elements 28 are preferably elastic, or at least slightly elastic, so that the web 17*c* of a guide member 17 can be caused to snap between their pallets and the adjacent portion of the surface 27 whereby the guide member 17 is adequately coupled to the holder 16, i.e., such guide member is held against movement in the direction of the arrow 23. The manner of securing the web of a guide member 19 to a holder 16 is analogous.

The reference character 30 denotes a handle on the portion 25. This handle facilitates manual separation of the holder 16 from a shaft 3 or 7.

The distance between the axes of the holes 18 in a holder section 26 and the axis of the respective shaft 3 or 7 is preferably selected in such a way that the distance between the prongs 17*a*, 17*b* of a properly mounted guide member 17 and the ideal path 22 for sheets 24 is less than one-half and most preferably less than one-third of the diameter D of a roller 4 or 8. The same preferably applies for the distance between the prongs of a properly mounted guide member 19 and the plane of the ideal path 22. As explained above, this ensures that the prongs of the guide members 17 or 19 can properly guide the leaders of successive sheets 24 irrespective of whether such leaders exhibit a tendency to curl upwardly (into the spaces between neighboring shafts 7) or downwardly (into the spaces between neighboring shafts 3).

The distance between the axes of neighboring shafts 3 or 7 is preferably a multiple of (at least twice) the diameter D of a roller 4 or 8, e.g., such distance may equal four outer diameters of a roller. This is desirable and advantageous because there is ample room between the neighboring rows of rollers 4 or 8 for admission of hot gaseous fluid to, as well as for withdrawal of spent (i.e., moisture-laden) fluid from, the region of the ideal path 22. Adequate room for admission of dry gaseous fluid streams and for withdrawal of moisture-laden fluid is important in order to prevent streaking of sheets as well as to ensure that the drying operation can be completed in a relatively short drying zone. The aforementioned selection of the diameter of the prongs of the guide members 17, 19 contributes to a reduction of the likelihood of streaking because the relatively thin prongs (whose diameter is preferably less than 2 mm and most preferably about 1 mm) are highly unlikely to "cast shadows" upon the respective sides of the sheets 24, i.e., to interfere with uniform distribution of a drying gas along the entire sides of the sheets between the two groups of rollers 4 and 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an apparatus for drying running strips or sheets of photographic material, the combination of first and second groups of transporting rollers having predetermined diameters and defining an elongated path for the advancement of photographic material in a predetermined direction; first and second groups of parallel shafts supporting the rollers of the respective groups, the shafts of each group of shafts being spaced apart from each other by distances each of which at least equals 2D wherein D is the diameter of a roller; and elongated guide members disposed at the opposite sides of the photographic material and extending in said direction to guide the photographic material in said path, the guide members at one side and the guide members at the other side of said path being separated from each other by a distance which is less than D.

2. The combination of claim 1, wherein said guide members consist of wire having a diameter of between 0.5 and 2 mm.

3. The combination of claim 2, wherein the diameter of the wire is approximately 1 mm.

4. The combination of claim 1, wherein each of said guide members includes a substantially U-shaped wire having a pair of elongated prongs and a web between the respective prongs.

5. The combination of claim 1, further comprising holders provided on at least one shaft at each side of said path, said holders having means for engaging the guide members at the respective sides of said path.

6. The combination of claim 5, wherein each of said holders comprises a substantially annular portion which surrounds the respective shaft between a pair of neighboring rollers of the respective group of rollers.

7. The combination of claim 6, wherein said annular portions are elastic.

8. The combination of claim 6, wherein each of said guide members comprises at least one elongated prong extending in said direction and said holders have sections which engage and maintain said prongs substantially tangentially of the respective groups of shafts.

9. The combination of claim 8, wherein each of said guide members has two substantially parallel prongs and said sections of said holders have pairs of holes for the prongs of the respective guide members.

10. The combination of claim 5, wherein each of said engaging means includes means for holding the respective guide members against movement in said direction.

11. The combination of claim 10, wherein each of said engaging means includes at least one elastically deformable hook-shaped coupling element and each of said guide members has a portion which is engaged by and releasably held by the corresponding coupling element.

12. The combination of claim 11, wherein said guide members are U-shaped and each thereof has two prongs and a web, said webs constituting those portions which are held by the respective coupling elements.

13. The combination of claim 1, further comprising means for moving one group of said shafts relative to the other group of said shafts.

14. The combination of claim 13, further comprising a housing, said housing including a first portion supporting the shafts of said other group and a second portion supporting the shafts of said one group and constituting said moving means, and means for pivotally connecting said second portion to said first portion.

15. The combination of claim 1, further comprising means for rotating the shafts of one of said groups.

16. The combination of claim 15, wherein said rollers consist of elastomeric material.

17. The combination of claim 1, wherein said rollers constitute elastically deformable annuli consisting of foamed material and having inner diameters which are smaller than the diameters of the respective shafts, said rollers being mounted on the respective shafts in expanded condition so that they engage the respective shafts by friction.

18. The combination of claim 1, further comprising holders secured to at least some of said first and second groups of shafts, each of said holders being flanked by two rollers on the respective shaft; and further comprising washers interposed between said holders and the neighboring rollers.

19. The combination of claim 1, further comprising holder means for securing said guide members to selected shafts of the respective groups.

20. The combination of claim 19, wherein said holder means are provided on alternate shafts of each of said groups.

* * * * *